US005439609A

United States Patent [19]

Paszek

[11] Patent Number: 5,439,609

[45] Date of Patent: Aug. 8, 1995

[54] AQUEOUS CLEANING COMPOSITION FOR HARD SURFACES

[75] Inventor: Leon E. Paszek, Mountainside, N.J.

[73] Assignee: Reckitt & Colman Inc., Montvale, N.J.

[21] Appl. No.: 174,078

[22] Filed: Dec. 28, 1993

[51] Int. Cl.[6] ..... C11D 3/37; C11D 3/075

[52] U.S. Cl. ..... 252/174.15; 252/173; 252/174.21; 252/174.22; 252/DIG. 2; 252/DIG. 11; 124/25.2; 124/40

[58] Field of Search ..... 252/174.15, 173, 174.21, 252/174.22, DIG. 2, DIG. 11; 134/25.2, 40, 25.1, 42

[56] References Cited

U.S. PATENT DOCUMENTS

| | | | |
|---|---|---|---|
| 4,374,745 | 2/1983 | Sibley et al. | 252/106 |
| 4,395,352 | 7/1983 | Kulkarni et al. | 252/321 |
| 4,501,680 | 2/1985 | Aszman et al. | 252/142 |
| 4,689,168 | 8/1987 | Requejo | 252/139 |
| 4,859,359 | 8/1989 | DeMatteo et al. | 252/174.15 |
| 4,948,531 | 8/1990 | Fuggini et al. | 252/544 |
| 4,960,533 | 10/1990 | Wisniewski et al. | 252/142 |
| 4,978,469 | 12/1990 | Seaman, Jr. | 252/170 |
| 5,254,284 | 10/1993 | Barone et al. | 252/174.15 |

FOREIGN PATENT DOCUMENTS

| | | |
|---|---|---|
| 0155099 | 12/1980 | Japan . |
| 0157698 | 12/1980 | Japan . |
| 3192198 | 8/1991 | Japan . |

*Primary Examiner*—Paul Lieberman
*Assistant Examiner*—Lorna M. Douyon
*Attorney, Agent, or Firm*—Frederick H. Rabin; J. Jeffrey Hawley

[57] ABSTRACT

An aqueous cleaning composition for cleaning hard surfaces has been discovered, the composition comprising: (a) from about 0.1 weight % to about 5 weight % of a siloxane block polymers as structurally represented by Formula A, as follows:

$$Me_3SiO(Me_2SiO)_x(\underset{\underset{PE}{|}}{MeSiO})_ySiMe_3$$

wherein PE is $CH_2CH_2CH_2O(EO)_mMe$, $—CH_2CH_2CH_2O(EO)_mH$, or $—CH_2CH_2CH_2O(PO)_nBu$, where EO is ethyleneoxy and PO is 1,2-propyleneoxy and said siloxane block polymer has a molecular weight ranging from about 3000 to about 4000; (b) from about 0.1 weight % to about 5 weight % of a $C_9$ to $C_{15}$ ethoxylate; (c) from about 1 weight % to about 10 weight % of a $C_4$–$C_9$ alkylene glycol $C_1$ to $C_3$ monoalkyl ether; and (d) from about 5 weight % to about 15 weight % of a chelating agent. The inventive composition imparts a residual protection on cleaned surfaces thereby assisting to hinder resoiling of the cleaned surface.

10 Claims, 2 Drawing Sheets

AQUEOUS CLEANING COMPOSITION FOR HARD SURFACES

FIELD OF THE INVENTION

This invention relates to cleaning compositions suited for hard surfaces, particularly tile surfaces.

BACKGROUND OF THE INVENTION

Although there are many known cleaning compositions for hard surfaces, alternative formulations are desirable. There is particular need for cleaning compositions directed against removing soap scum build-up from tile surfaces.

Soap scum build-up is a problem encountered particularly in bathrooms with ceramic tile. Typically removal of the scum requires a rubbing or wiping of the surface after treatment with the cleaning composition. Penetrating beneath the scum in removing the build-up is the most desirable method of removal. Formulating a cleaning composition for such the penetrating action is difficult, however, particularly because many formulations leave an undesirable smearing or streaking effect on the tile after cleaning.

It would be commercially valuable to formulate a cleaning composition that effectively cleans as well as imparts a residual protection on the cleaned tile. The residual protection would reducing the build-up of soap scum for a period of time after the cleaning and thus reduce the need for frequent cleaning. Imparting this residual protection on hard surfaces is problematic, however, because ingredients (such as, for example cyclomethicone) typically provide a coating type of effect which tends to leave the surface with an undesirable greasy, slippery type of film.

Alternative cleaning compositions that provide good cleaning capability as well as residual protection against soiling are needed.

SUMMARY OF THE INVENTION

The above-identified need has been met with the discovery of an aqueous cleaning composition comprising: (a) from about 0.1 weight % to about 5 weight % of a siloxane block polymer having the formula:

$$Me_3SiO(Me_2SiO)_x(\underset{\underset{PE}{|}}{MeSiO})_ySiMe_3$$

wherein PE is $—CH_2CH_2CH_2O(EO)_mMe$, $—CH_2CH_2CH_2O(EO)_mH$, or $—CH_2CH_2CH_2O(PO)_nBu$, where EO is ethyleneoxy and PO is 1,2-propyleneoxy and said siloxane block polymer has a molecular weight ranging from about 3000 to about 4000; (b) from about 0.1 weight % to about 5 weight % of a $C_9$ to $C_{15}$ ethoxylate; (c) from about 1 weight % to about 10 weight % of a $C_4$–$C_9$ alkylene glycol $C_1$–$C_3$ monoalkyl ether; and (d) from about 5 weight % to about 15 weight % of a chelating agent, wherein all weight percentages used herein represent active ingredient weight percentages based on the total weight of the aqueous composition. The inventive composition exhibits good cleaning capability. Additionally, the inventive composition imparts a residual protection on cleaned surfaces thereby assisting to hinder resoiling of the cleaned surface.

Further, cleaning of hard surfaces using the inventive composition is accomplished without leaving an undesirable streaking or smearing effect on the cleaned surface.

DETAILED DESCRIPTION OF THE INVENTION

Figure 1:
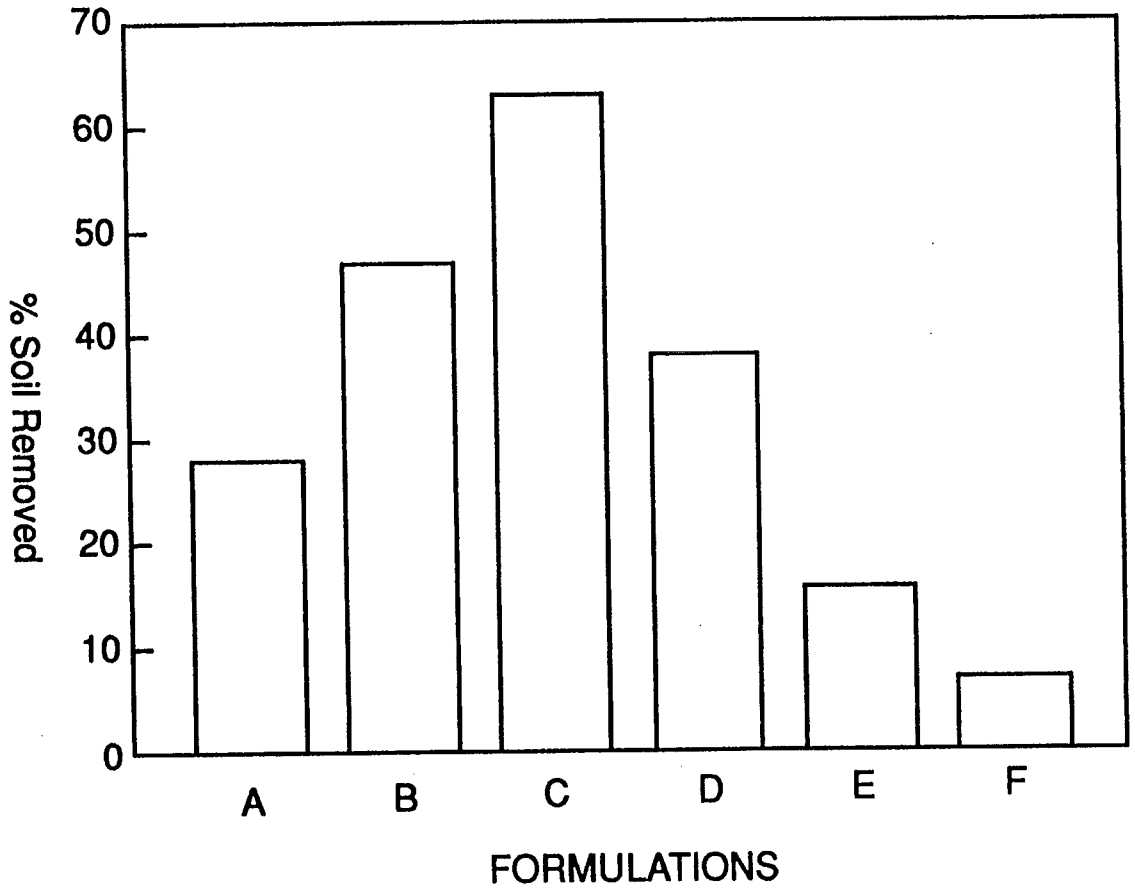
FIG. 1 illustrates the average % soil removal of five cleaning cycles using Formulations A–F, as described in more detail in the Examples section.

It has been found that three siloxane block polymers (and mixtures thereof) impart a residual protection against resoiling as well as providing an improved cleaning capability when included in a cleaning composition. The three siloxane block polymers are linear polydimethylsiloxanes to which polyethers have been grafted through a hydrosilation reaction. This process results in an alkyl-pendant copolymer, in which the polyalkylene oxide groups are attached along the siloxane backbone through a series of hydrolytically stable Si—C bonds. The three siloxane block polymers are of the following general formula A:

$$Me_3SiO(Me_2SiO)_x(\underset{\underset{PE}{|}}{MeSiO})_ySiMe_3$$

where PE is $—CH_2CH_2CH_2O(EO)_mMe$, $—CH_2CH_2CH_2O(EO)_mH$, or $—CH_2CH_2CH_2O(PO)_nBu$, where EO is ethyleneoxy and PO is 1,2-propyleneoxy, Me is methyl, Bu is butyl, Si is silicone, and the coefficients x, y, m and n are valued such that the polymers have a molecular weight ranging from about 3000 to about 4000. The three surfactants are available commercially as SILWET TM L-7600 [where PE is a $—CH_2CH_2CH_2O(EO)_mMe$ group], SILWET TM L-7604 [where PE is a $—CH_2CH_2CH_2O(EO)_mH$ group], and SILWET TM L-7500 [where PE is $—CH_2CH_2CH_2O(PO)_nBu$ group], as defined by Formula A above. Most preferably employed is SILWET TM L-7500. The SILWET TM surfactants as defined are available from OSi Specialties, Inc. (Danbury, Conn., formerly Union Carbide Organo Silicon Products, Systems and Services). As shown in the Examples section, all surfactants in the SILWET TM series do not impart the desired cleaning and residual protection. In fact, as the Examples demonstrate, several of the SILWET TM products demonstrated an adhesive property thus promoting the soap scum to attach to the tile.

As with the other ingredients of this composition, the amount of the siloxane block polymer used in the formula may vary depending upon the desired concentration of the composition as well as the use of the composition, type of surface to be cleaned, and so on. For common usage, the preferred amount employed ranges from about 0.1 weight percent to about 5 weight %, more preferably from 0.5 weight % to 2 weight %, and most preferably from 1 weight % to 2 weight %.

The $C_9$–$C_{15}$ ethoxylate ingredient is well-known and widely available commercially, for example under the tradename NEODOL TM ethoxylate series, as sold by Shell Chemical Company. More preferably the ethoxylate is a blend of linear alcohols containing from 12 to 15 carbon atoms and from about 3 to about 12 ethylene oxide (EO) groups/alcohol, mole/mole average (as sold as the NEODOL TM 25 ethoxylate series). Most preferably used is an ethoxylate having a 12–15 carbon atom linear alcohol blend with approximately 7 moles EO/-mole alcohol (currently sold as NEODOL TM 25-7). The preferred amount of the ethoxylate used in the composition ranges from about 0.1 weight % to about 2 weight %, more preferably from 0.5 weight % to 1.5 weight %, and most preferably from 0.5 weight % to 1 weight %.

The $C_4$–$C_9$ alkylene glycol mono $C_1$–$C_3$ alkyl ingredient is characterized by low odor, good solvent properties, good chemical stability and low volatility. Most preferably employed is propylene glycol monopropyl ether having the formula $C_3H_7OCH_2CH(CH_3)OH$ (available, for example, as Propyl PROPASOL TM Solvent from Union Carbide Corporation, Danbury, Conn.). The amount of the alkylene glycol used in the formulation may vary. Useful amounts used range of from about 1 weight % to about 10 weight %, more preferably from 2 weight % to 7.5 weight %, and most preferably from 3 weight % to 6 weight %.

A variety of chelating agents may be used, as described in *Kirk-Othmer Encyclopedia of Chemical Technology*, Vol. 5, pp. 339–366 (1979). More preferred chelating agents include sodium tripolyphosphate (STPP), citric acid, ethylenediaminetetraacetic acid (EDTA), organophosphonates, gluconic acid and mixtures thereof. Most preferably EDTA is employed. The preferred amount of chelating agent is within the range from about 1 weight percent to about 10 weight %, more preferably from 2 weight % to 8 weight %, and most preferably from 3 weight % to 6 weight %.

In addition to the ingredients listed above, the composition may also contain additional optional ingredients such as dyes, perfumes, and so on.

As stated above, the aqueous composition contains a substantial balance of water. The composition may also be prepared as a concentrate which may then be diluted prior to usage, as accomplished by techniques of those skilled in the art. Active ingredient weight percentages omitting water, may be easily calculated from those weight percentages as previously set forth (which have included the water balance percentage).

The inventive composition is an effective cleaner that may be used to clean a number of hard surfaces. Although not wishing to be bound by theory, it is believed that the composition has a penetrating cleaning action that results is soil, particularly soap scum, to easily separate from the soiled surface. Thus less rubbing action is required in cleansing the surface. Also, as described previously, and illustrated in the Examples section hereinafter, the inventive composition imparts a residual protection effect that leaves the cleaned surface resistant to resoiling.

The composition is generally prepared as a liquid that may be applied to the surface to be cleansed by any number of techniques, as known to those skilled in the art. Particularly useful for bathroom use, the composition may be applied by a trigger style container so that the composition is directly contacted with the surface by spraying. The sprayed surface may then be wiped by a cloth or rinsed with water to assist in removing the soil.

The invention may be put into practice in various ways and a number of non-limiting, specific embodiments will be described in the following examples to further illustrate the above-described invention.

EXAMPLES

Examples 1

As shown in Table A, hereinafter, Compositions A–J were prepared with a number of siloxane block polymers marketed in the SILWET TM surfactants series, (as sold by OSi Specialties, Inc., Danbury, Conn.). As shown the compositions varied only with respect to the type of SILWET product used. Composition A represents a Control, where no SILWET was included. Compositions B, C, and D represent the invention. Compositions E-J represent Comparisons.

TABLE A

| Formula (Ingredients) | A (Control) | B | C | D | E | F | G | H | I | J |
|---|---|---|---|---|---|---|---|---|---|---|
| $Na_4$ (EDTA)[1] (38%) | 10 | 10 | •→ | → | → | → | → | → | → | → |
| PROPASOL P TM[2] | 5 | 5 | •→ | → | → | → | → | → | → | → |
| NEODOL TM 25-7[3] | 0.65 | 0.65 | •→ | → | → | → | → | → | → | → |
| WATER | 84.35 | 83.35 | •→ | → | → | → | → | → | → | → |
| SILWET TM L-7600[4] | — | 1 | — | — | — | — | — | — | — | — |
| SILWET TM L-7500 | — | | 1 | — | — | — | — | — | — | — |
| SILWET TM L-7604 | — | | | 1 | — | — | — | — | — | — |
| SILWET TM L-7607 | — | | | | 1 | — | — | — | — | — |
| SILWET TM L-720 | — | | | | | 1 | — | — | — | — |
| SILWET TM L-7200 | — | | | | | | 1 | — | — | — |
| SILWET TM L-7100 | — | | | | | | | 1 | — | — |
| SILWET TM L-7210 | — | | | | | | | | 1 | — |
| SILWET TM L-7605 | — | | | | | | | | | 1 |
| TOTAL | 100 | 100 | •→ | → | → | → | → | → | → | → |

[1] Sodium Ethylenediaminetetraacetic Acid (38% Active).
[2] Propylene Glycol Monopropyl Ether, obtained from Union Carbide, (100% Active).
[3] 12–15 Carbon linear alcohol blend having approx 7 moles EO/mole alcohol (obtained from Shell Chem. Co.)
[4] All SILWET TM products are described in "Silwet Surfactants" Catalogue (1992) of OSi Specialties, Union Carbide Chemicals and Plastics Company, Inc. Specialty Chemical Division, 39 Old Ridgebury Road, Danbury, CT.

Example 2

Compositions A–J shown in Table A were tested for cleaning capability against synthetic soap scum and residual protection against synthetic soap scum.

The synthetic soap scum was prepared by first preparing a Solution "A" (a 3% steric acid solution) and a Solution "B" (a hard water spray).

Solution A was prepared by dissolving 3 Grams of triple pressed stearic acid in ethyl alcohol and making the total weight equal to 100.

Solution B was prepared by dissolving 2.64 Grams of $CaCl_2 \cdot 2H_2O$ and 2.95 Grams of $MgSO_4 \cdot 7H_2O$ in water and making the final volume 1000 ml.

New 4"×4" black ceramic tiles were rinsed with water and wiped with isopropanol, then air dried. All tests were accomplished employing tiles from the same lot.

A cleaning test was conducted and the amount of soil removed was measured by reflectance readings taken using a BYK Gardner Reflectometer Model #4525 (micro-TRI-Gloss meter, sold by Gardner Corp., Silver Spring, Md.) set at 20°. A reflectance reading was taken prior to the soiling process ("Original Rf."); after the soiling process ("Soiled Rf."); and after the cleaning process using the Formulations (Cleaned Rf.), where Rf. is an abbreviation of Reflectance Reading. The % Soil Removed was calculated using the following formula.

$$\% \text{ Soil Removed} = \frac{\text{Cleaned Rf.} - \text{Soiled Rf.}}{\text{Original Rf.} - \text{Soiled Rf.}} \times 100\%$$

The cleaning test was accomplished by soiling the tiles uniformly with Solution A followed immediately with Solution B. An ALLTECH TM sprayer obtained from Alltech Associates, catalogue number 14654, Deerfield, Ill. was used to spray Solutions A and B. The sprayed tiles were allowed to air dry for 15 minutes, followed by a curing at 80° C. for approximately 45 minutes. The cured tiles were then cooled to room temperature, misted with cold soft water, and then blotted dry with a paper towel. A reflectance reading was then taken ("Soiled Rf.")

The soiled tiles were cleaned with the respective test formulas by spraying the tiles with 3–4 gms (4 pumps) of the test formula using a pump sprayer held at a distance of about 6 inches from the tile. After waiting approx. one minute, the tile was rinsed under cold tap water for approx. 15–20 seconds, drained, blotted with a paper towel, and allowed to air dry. In order to test for a residual protection, the resoiled tiles were rinsed under cold water by holding each tile at a 45° angle about 12 inches from the faucet and passed under the cold running water about five times. The tiles were then inverted and again the soiled side was passed under the running water. The rinsed tiles were then blotted gently with a paper towel, air dried and the a reflectance reading taken ("Cleaned Rf.). This represented one cycle and the "% Soil Removed" was calculated using the reflectance measurements taken.

Figure 2:
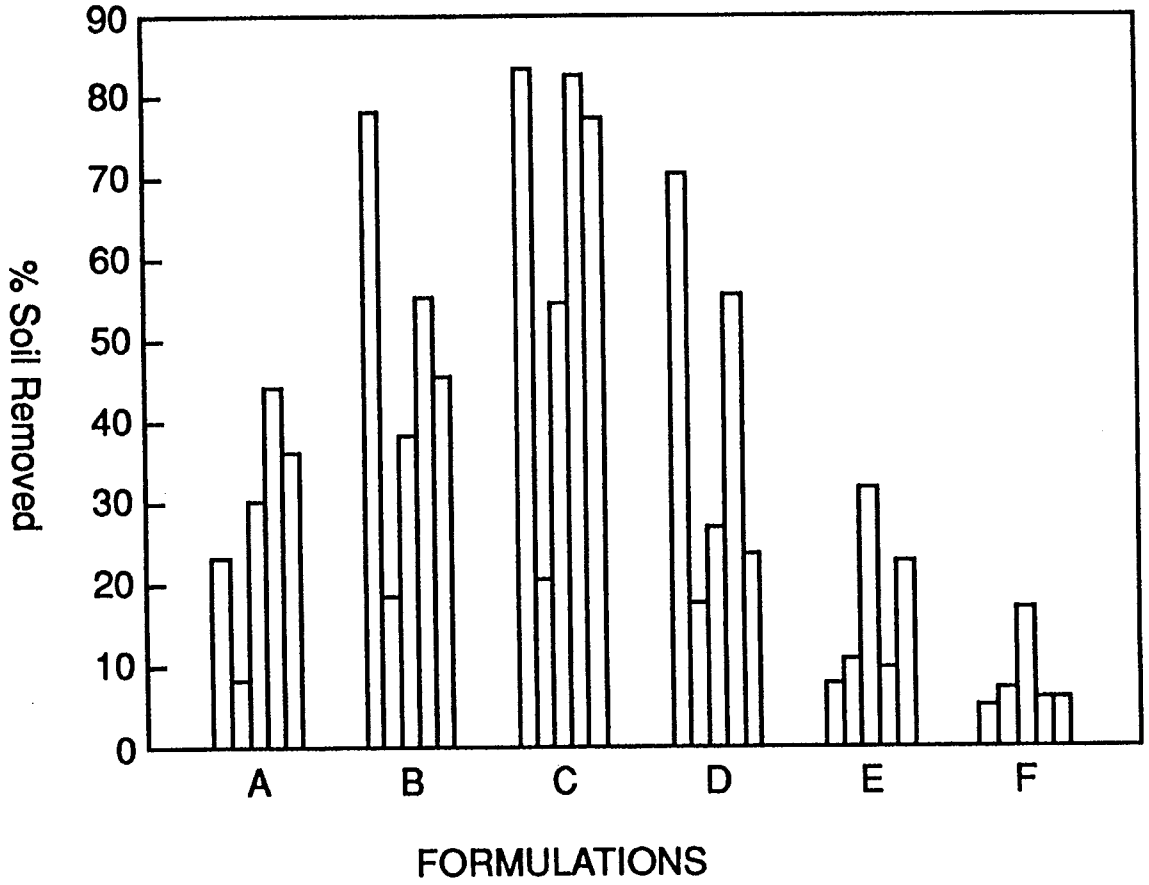
FIG. 2 illustrates the % soil removal for each of the five individual cleaning cycles using Formulations A–F, as described in more detail in the Examples section.

The above steps were repeated for a total of five cycles. The % Soil Removed calculation are summarized in Table B hereinafter. An average of the % Soil Removed data for the five cycles was calculated, as shown in Table B, and graphically illustrated in FIG. 1. The % Soil Removed data for each of the five cycles is graphically illustrated in FIG. 2.

TABLE B

| | % SOIL REMOVED | | | | | | | | | |
|---|---|---|---|---|---|---|---|---|---|---|
| FORMULA | A | B | C | D | E | F | G | H | I | J |
| First Cycle | 23 | 78 | 83 | 70 | 7 | 4 | 7 | 6 | 7 | 2 |
| Second Cycle | 8 | 18 | 20 | 17 | 10 | 6 | 15 | 21 | 21 | 14 |
| Third Cycle | 30 | 38 | 54 | 26 | 31 | 16 | 21 | 20 | 23 | 24 |
| Fourth Cycle | 44 | 55 | 82 | 55 | 9 | 5 | 10 | 10 | 19 | 24 |

TABLE B-continued

| | % SOIL REMOVED | | | | | | | | | |
|---|---|---|---|---|---|---|---|---|---|---|
| FORMULA | A | B | C | D | E | F | G | H | I | J |
| Fifth Cycle | 36 | 45 | 77 | 23 | 22 | 5 | 10 | 6 | 11 | 14 |
| Total | 141 | 234 | 316 | 191 | 79 | 36 | 63 | 63 | 81 | 78 |
| Average | 28 | 47 | 63 | 38 | 16 | 7 | 12 | 13 | 16 | 15 |

The comparative data suggest that Compositions E–F (Comparisons) demonstrate an adhesive characteristic such that the synthetic soap scum actually adheres more to cleaning compositions when SILWET products L-7607, L-720, L-7200. L-7100, L-7210, and L-7605 were included.

That which is claimed is:

1. An aqueous cleaning composition comprising:

(a) from about 0.1 weight % to about 5 weight % of a siloxane block polymer structurally represented by the formula:

$$Me_3SiO(Me_2SiO)_x(\underset{\underset{PE}{|}}{MeSiO})_ySiMe_3$$

wherein PE is $—CH_2CH_2CH_2O(PO)_nBu$, PO is 1,2-propyleneoxy, Bu is butyl and the coefficients x, y and n are positive integers such that said siloxane block polymer has a molecular weight ranging from about 3000 to about 4000;

(b) from about 0.1 weight % to about 5 weight % of a $C_9$–$C_{15}$ ethoxylate;

(c) from about 1 weight % to about 10 weight % of a $C_4$–$C_9$ alkylene glycol $C_1$–$CH_3$ monoalkyl ether; and (d) from about 5 weight % to about 15 weight % of a chelating agent, wherein all weight percentages used herein represent active ingredient weight percentages based on the total weight of the aqueous composition.

2. A composition according to claim 1 wherein:

(a) is present in an amount ranging from 0.5 weight % to 2 weight %;

(b) is present in an amount ranging from 0.5 weight % to 1.5 weight %;

(c) is present in an amount ranging from 2 weight % to 7.5 weight %; and (d) is present in an amount ranging from 2 weight % to 8 weight %.

3. A composition according to claim 2 wherein:

(a) is present in an amount ranging from 1 weight % to 2 weight %;

(b) is present in an amount ranging from 0.5 weight % to 1 weight %;

(c) is present in an amount ranging from 3 weight % to 6 weight %; and (d) is present in an amount ranging from 3 weight % to 6 weight %.

4. A composition according to claim 1 wherein (b) is a ethoxylate having a 12–15 carbon atom linear alcohol blend with about 7 moles of ethylene oxide group per mole of alcohol.

5. A composition according to claim 4 wherein (c) is a propylene glycol monopropyl ether.

6. A composition according to claim 5 wherein (d) is a ethylenetriaminepentaacetic acid or a salt thereof.

7. A soap scum tile cleaner consisting essentially of:

(a) from about 0.1 weight % to about 5 weight % of a siloxane block polymer structurally represented by the formula:

$$Me_3SiO(Me_2SiO)_x(\underset{\underset{PE}{|}}{MeSiO})_ySiMe_3$$

wherein PE is $—CH_2CH_2CH_2O(PO)_nBu$, PO is 1,2-propyleneoxy, Bu is butyl and the coefficients x, y and n are positive integers such that said siloxane block polymer has a molecular weight ranging from about 3000 to about 4000;

(b) from about 0.1 weight % to about 5 weight % of a $C_9$–$C_{15}$ ethoxylate;

(c) from about 1 weight % to about 10 weight % of a $C_4$–$C_9$ alkylene glycol $C_1$–$C_3$ monoalkyl ether; and (d) from about 5 weight % to about 15 weight % of a chelating agent, wherein all weight percentages used herein represent active ingredient weight percentages based on the total weight of the aqueous composition.

8. A soap scum tile cleaner according to claim 7 wherein:

(a) is present in an amount ranging from 1 weight % to 2 weight %;

(b) is present in an amount ranging from 0.5 weight % to 1 weight %;

(c) is present in an amount ranging from 3 weight % to 6 weight %; and (d) is present in an amount ranging from 3 weight % to 6 weight %.

9. A method for removing soap scum from a hard surface comprising treating said surface with a composition comprising:

(a) from about 0.1 weight % to about 5 weight % of a siloxane block polymer structurally represented by the formula;

$$Me_3SiO(Me_2SiO)_x(\underset{\underset{PE}{|}}{MeSiO})_ySiMe_3$$

wherein PE is $—CH_2CH_2CH_2O(PO)_nBu$, PO is 1,2-propyleneoxy, Bu is butyl and the coefficients x, y and n are positive integers such that said siloxane block polymer has a molecular weight ranging from about 3000 to about 4000;

(b) from about 0.1 weight % to about 5 weight % of a $C_9$–$C_{15}$ ethoxylate;

(c) from about 1 weight % to about 10 weight % of a $C_4$–$C_9$ alkylene glycol $C_1$–$C_3$ monoalkyl ether; and (d) from about 5 weight % to about 15 weight % of a chelating agent, wherein all weight percentages used herein represent active ingredient weight percentages based on the total weight of the aqueous composition.

10. A method according to claim 9 wherein in said composition:

(a) is present in an amount ranging from 1 weight % to 2 weight %;

(b) is present in an amount ranging from 0.5 weight % to 1 weight %;

(c) is present in an amount ranging from 3 weight % to 6 weight %; and (d) is present in an amount ranging from 3 weight % to 6 weight %.

* * * * *